US011548293B2

(12) United States Patent
Watanabe et al.

(10) Patent No.: US 11,548,293 B2
(45) Date of Patent: Jan. 10, 2023

(54) PROCESSING DEVICE AND PLATEN

(71) Applicant: BROTHER KOGYO KABUSHIKI KAISHA, Nagoya (JP)

(72) Inventors: Takeshi Watanabe, Nagoya (JP); Shuichi Tamaki, Nagoya (JP); Kenji Sato, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 292 days.

(21) Appl. No.: 16/431,293

(22) Filed: Jun. 4, 2019

(65) Prior Publication Data

US 2019/0366740 A1 Dec. 5, 2019

(30) Foreign Application Priority Data

Jun. 4, 2018 (JP) ..... JP2018-107306

(51) Int. Cl.

| | |
|---|---|
| ***B41J 11/00*** | (2006.01) |
| ***B41J 3/407*** | (2006.01) |
| ***B41J 11/06*** | (2006.01) |
| ***B41J 11/20*** | (2006.01) |

(52) U.S. Cl.

CPC ..... *B41J 3/4078* (2013.01); *B41J 11/0095* (2013.01); *B41J 11/06* (2013.01); *B41J 11/20* (2013.01); *B41J 11/002* (2013.01)

(58) Field of Classification Search

None

See application file for complete search history.

(56) References Cited

U.S. PATENT DOCUMENTS

| | | | | |
|---|---|---|---|---|
| 5,810,487 | A * | 9/1998 | Kano | B41J 3/28 400/83 |
| 6,758,802 | B2 * | 7/2004 | Fitzgerald | G06Q 10/10 235/375 |
| 8,170,712 | B2 | 5/2012 | Battles et al. | |
| 8,905,657 | B2 | 12/2014 | Grunenberg et al. | |
| 2009/0110829 | A1 | 4/2009 | Johnson et al. | |
| 2010/0189488 | A1 | 7/2010 | Grunenberg et al. | |

(Continued)

FOREIGN PATENT DOCUMENTS

| | | | |
|---|---|---|---|
| CN | 102103718 | A | 6/2011 |
| CN | 103909735 | A | 7/2014 |
| DE | 102007036374 | A1 | 2/2009 |
| EP | 2871059 | A1 | 5/2015 |
| JP | 2005247432 | A | 9/2005 |

(Continued)

OTHER PUBLICATIONS

Chinese Office Action dated Jun. 24, 2020 in corresponding Chinese Patent Application No. 201910468510.4.

(Continued)

*Primary Examiner* — Jill E Culler

(74) *Attorney, Agent, or Firm* — K&L Gates LLP

(57) ABSTRACT

A processing device capable of performing appropriate processing on a set platen, and a platen are provided. A platen that is used in a printer and at least one of a pretreatment device and a post-treatment device is provided with a platen identification information portion that identifies the platen. A code reader receives platen identification information that identifies the platen, from the platen identification information portion. The printer and at least one of the pretreatment device and the post-treatment device perform processing on the basis of the platen identification information received by the code reader.

13 Claims, 22 Drawing Sheets

(56) References Cited

U.S. PATENT DOCUMENTS

| | | | | |
|---|---|---|---|---|
| 2011/0178633 | A1* | 7/2011 | Marrese | G06Q 10/087 700/229 |
| 2013/0335467 | A1 | 12/2013 | Gerber | |
| 2014/0184675 | A1 | 7/2014 | Tamaki | |
| 2015/0183219 | A1 | 7/2015 | Kakigahara | |
| 2017/0341424 | A1 | 11/2017 | Sakai | |

FOREIGN PATENT DOCUMENTS

| | | | |
|---|---|---|---|
| JP | 2009-045826 | A | 3/2009 |
| JP | 2010534582 | A | 11/2010 |
| JP | 2013-019083 | A | 1/2013 |
| JP | 2014139103 | A | 7/2014 |
| JP | 2017202679 | A | 11/2017 |
| JP | 2018066097 | A | 4/2018 |
| WO | 2009/015781 | A2 | 2/2009 |

OTHER PUBLICATIONS

Extended European Search Report issued in corresponding European Application No. 19177510.5, dated Oct. 18, 2019.
Chinese Office Action dated Nov. 5, 2021, in corresponding Chinese Patent Application No. 201910468510.4.
Office Action dated Apr. 28, 2021 in corresponding Chinese Patent Application No. 201910468510.4.
Office Action issued in corresponding Japanese patent application No. 2018-107306, dated Jun. 21, 2022 (2 pages).
Japanese Office Action dated Feb. 1, 2022, in corresponding Japanese Patent Application No. 2018-107306 (8 pages).

* cited by examiner

FIG. 7

80

| PLATEN IDENTIFICATION INFORMATION | PRINT MEDIUM INFORMATION | ERROR INFORMATION | PROCESSING COMPLETION INFORMATION | PRINT DATA | HEIGHT INFORMATION |
|---|---|---|---|---|---|
| PID1 | ID1 | PLATEN SIZE | . . | . . | . . |
| PID2 | ID2 | . . | PRETREATMENT COMPLETE | RPD1 | . . |
| PID3 | ID3 | . . | PRINTING COMPLETE | . . | . . |
| . . . | . . . | . . . | . . . | . . . | . . . |

FIG. 8

81

| PRETREATMENT CONDITIONS | PRINT MEDIUM INFORMATION | ID1 | ID2 | ID3 | ・・・ |
|---|---|---|---|---|---|
| APPLICATION CONDITIONS | APPLICATION AMOUNT PER UNIT AREA (mg/cm$^2$) | C1 | – | C3 | ・・・ |
| | APPLICATION RANGE | CR1 | – | CR3 | ・・・ |
| | TYPE OF PRETREATMENT AGENT | L1 | – | L3 | ・・・ |
| HEAT TREATMENT CONDITIONS | HEAT TREATMENT PRESSURE (N/cm$^2$) | P1 | P2 | P3 | ・・・ |
| | HEAT TREATMENT TIME PERIOD (sec) | T1 | T2 | T3 | ・・・ |
| | HEAT TREATMENT TEMPERATURE (°C) | TP1 | TP2 | TP3 | ・・・ |
| | HEAT TREATMENT RANGE | PR1 | PR2 | PR3 | ・・・ |
| | NUMBER OF TIMES OF HEAT TREATMENT | NT1 | NT2 | NT3 | ・・・ |

FIG. 9

82

| PRINT MEDIUM INFORMATION | PRINT DATA |
|---|---|
| ID1 | PD1 |
| ID2 | PD2 |
| ID3 | PD3 |
| ⋮ | ⋮ |

FIG. 10

83

| POST-TREATMENT CONDITIONS | PRINT MEDIUM INFORMATION | ID1 | ID2 | ID3 | . . . |
|---|---|---|---|---|---|
| HEAT TREATMENT CONDITIONS | HEAT TREATMENT TIME PERIOD (sec) | T1 | T2 | T3 | . . . |
| | HEAT TREATMENT TEMPERATURE (°C) | TP1 | TP2 | TP3 | . . . |

FIG. 18

84

| Job1.txt |
| --- |
| PlatenID=23<br>PT_Amount=35<br>PrintData="SERVER NAME¥AAA¥BBB.prn" |

PROCESSING DEVICE AND PLATEN

CROSS-REFERENCE TO RELATED APPLICATION

This application claims priority to Japanese Patent Application No. 2018-107306 filed Jun. 4, 2018. The contents of the foregoing application are hereby incorporated herein by reference.

BACKGROUND

The present disclosure relates to a processing device and a platen.

An inkjet textile printer is known that performs pretreatment before print processing. For example, an inkjet textile printer is provided with a textile printing execution portion and a pretreatment portion. Before the textile printing execution portion ejects ink onto a material to be printed, the pretreatment portion performs processing to smooth out wrinkles of the material to be printed. Further, the pretreatment portion also performs other processing, such as processing to apply a coating liquid, which is used as a pretreatment agent, onto the material to be printed.

SUMMARY

In the inkjet textile printer, when the pretreatment is performed by the pretreatment portion, if a platen other than a predetermined platen, such as a platen that does not have a predetermined size or a platen that does not have a predetermined height, is used, there is a possibility that a failure may occur in the pretreatment onto the material to be printed set on the platen. If the failure occurs in the pretreatment, when textile printing processing is performed, there is a possibility that a textile printing failure, such as bleeding, may occur in the material to be printed. Further, when the textile printing processing is performed by the textile printing execution portion, if a platen other than the predetermined platen, such as a platen that does not have the predetermined size or a platen that does not have the predetermined height, is used, there is a possibility that the textile printing processing cannot be performed in accordance with predetermined textile printing conditions and the textile printing failure may occur.

Further, even when a sensor is provided between the pretreatment portion and the textile printing execution portion and the position and the height of the platen on which the material to be printed has been set are detected, if the platen is removed in the course of the processing, there is a possibility that the textile printing execution portion cannot perform the textile printing processing on the material to be printed set on the platen.

Embodiments of the broad principles derived herein provide a processing device capable of performing appropriate processing on a set platen, and a platen.

A processing device according to a first aspect of the present disclosure includes: a first receiving portion configured to receive, from a platen identification information portion provided on a platen, platen identification information that identifies the platen, the platen being used in a printer and in a related device that is at least one of a pretreatment device and a post-treatment device; and a first processing portion configured to perform processing in one of the printer and the related device, on the basis of the platen identification information received by the first reception portion.

The first processing portion performs the processing in one of the printer and the related device on the basis of the platen identification information received by the first reception portion. It is therefore possible to increase a possibility that appropriate processing will be performed with respect to the platen.

A platen according to a second aspect of the present disclosure is a platen used in a printer and in a related device that is at least one of a pretreatment device and a post-treatment device. The platen includes: a plate on which a print medium is set, the print medium being a processing target of one of the printer and the related device; and a platen identification information portion provided on the platen. The platen identification information portion is associated with processing in one of the printer and the related device, and indicates platen identification information that identifies the platen.

The platen identification information portion is associated with the processing in one of the printer and the related device, and indicates the platen identification information that identifies the platen. Therefore, in the printer or the related device, the processing can be performed on the basis of the platen identification information received from the platen identification information portion.

BRIEF DESCRIPTION OF THE DRAWINGS

Embodiments will be described below in detail with reference to the accompanying drawings in which:

FIG. 7 is a diagram showing an example of an association table 80;

FIG. 8 is a diagram showing an example of a first table 81;

FIG. 9 is a diagram showing an example of a second table 82;

FIG. 10 is a diagram showing an example of a third table 83;

FIG. 18 is an example of a text file.

DETAILED DESCRIPTION

Figure 1:
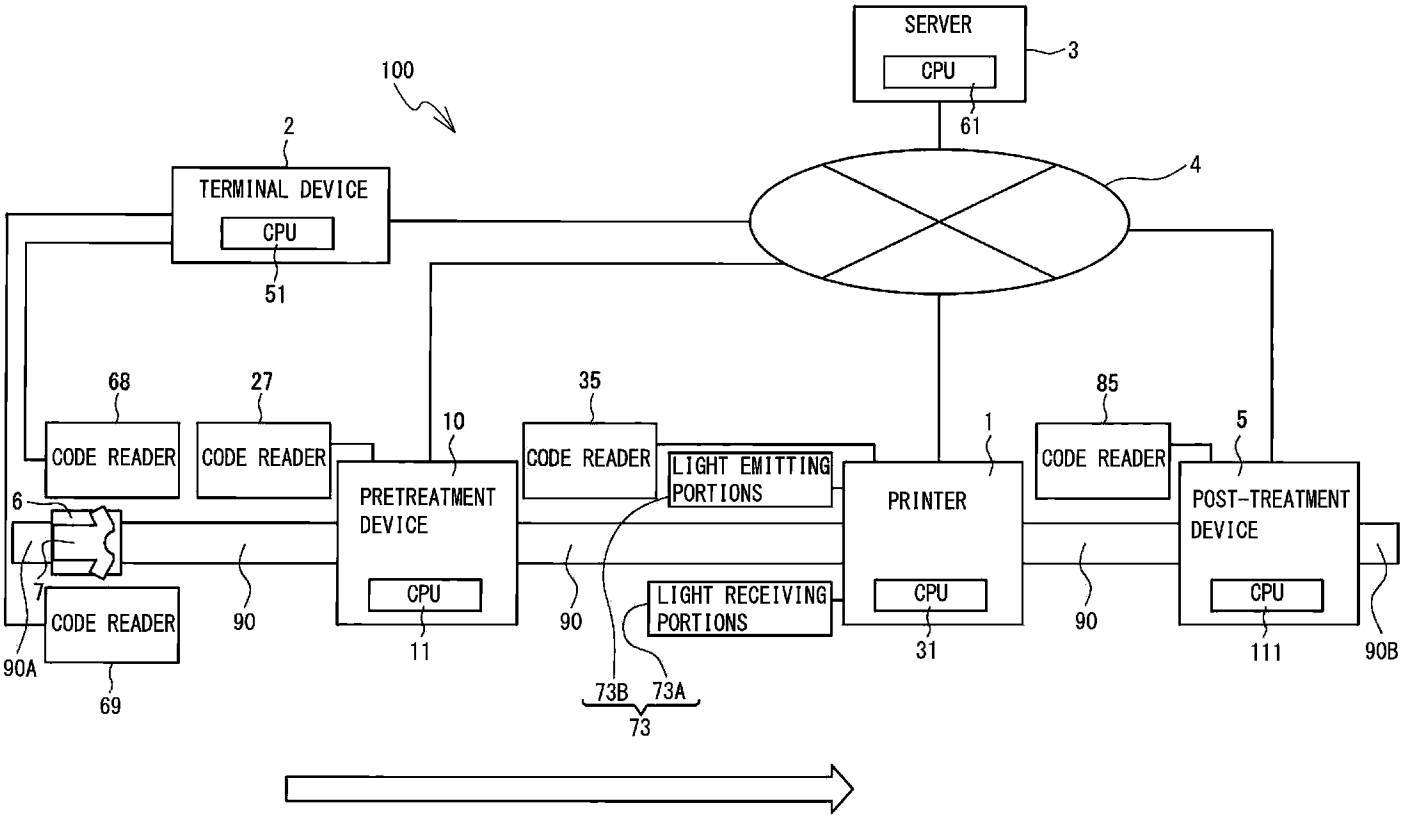
FIG. 1 is a diagram showing an example of a configuration of a print processing system 100.

A processing device and a platen of a first embodiment of the present disclosure will be explained with reference to the drawings. In the present embodiment, a print medium 7 is placed on a platen 6 to be described later. An example of the print medium 7 is a cloth, such as a T-shirt. Examples of a material of the cloth include cotton, polyester, a cotton/polyester mix, and the like. The platen 6 is used in a pretreatment device 10, a printer 1 and a post-treatment device 5, which will be described later. The pretreatment device 10, the printer 1 and the post-treatment device 5 are respectively provided with code readers 27, 35 and 85 to be described later. The code readers 27, 35 and 85 receive platen identification information from a platen identification information portion 608 (refer to FIG. 11 and FIG. 12) of the platen 6. With respect to the print medium 7 placed on the platen 6, the pretreatment device 10 performs pretreatment to be described later, the printer 1 performs print processing to be described later, and the post-treatment device 5 performs post-treatment to be described later.

Print Processing System 100

As shown in FIG. 1, the print processing system 100 is provided with the pretreatment device 10, the printer 1, the post-treatment device 5, a terminal device 2 and a server 3 that are mutually connected via a network 4. The network 4 is, for example, a LAN, an intranet, the Internet or the like. Further, the terminal device 2, the pretreatment device 10, the printer 1, the post-treatment device 5 and the server 3 may be each connected via a serial cable that can be connected to a serial port, such as a universal serial bus (USB). Further, the connection via the network 4 and the connection via the serial cable may be mixed. A platen conveyance mechanism 90 that conveys the platen 6 is provided between each of the pretreatment device 10, the printer 1 and the post-treatment device 5. The platen conveyance mechanism 90 conveys the platen 6 in order of the pretreatment device 10, the printer 1 and the post-treatment device 5. The platen conveyance mechanism 90 is formed by a guide rail, a gear mechanism, a motor and the like that are not shown in the drawings. In the platen conveyance mechanism 90, a position at which the print medium 7 is mounted on the platen 6 is referred to as a mounting position 90A, and a position at which the print medium 7 is detached from the platen 6 is referred to as a detachment position 90B.

Configuration of Pretreatment Device 10

Figure 2:
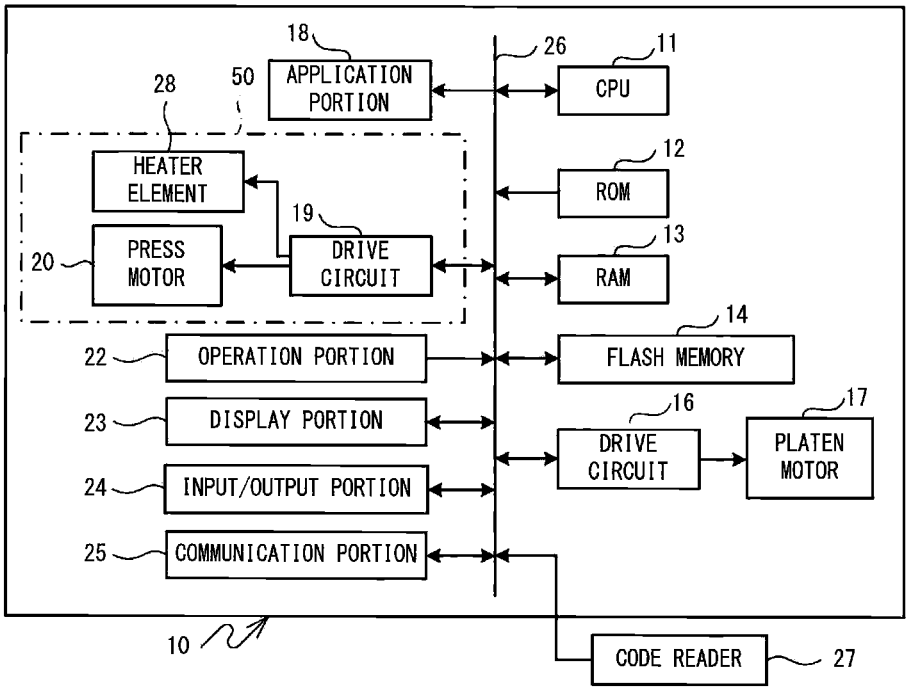
FIG. 2 is a block diagram showing an example of an electrical configuration of a pretreatment device 10.

As shown in FIG. 2, the pretreatment device 10 is provided with an application portion 18, a heat treatment portion 50 and the like. The platen 6 on which the print medium 7 has been placed is conveyed to the application portion 18 and to the heat treatment portion 50 by an internal platen conveyance mechanism (not shown in the drawings) that is formed by a platen motor 17 and the like. The platen motor 17 is a stepping motor, for example. The application portion 18 is provided with, for example, a plurality of sprays (not shown in the drawings), and sprays a pretreatment agent from the sprays, thus applying the pretreatment agent onto the print medium 7 placed on the platen 6. The pretreatment agent is a liquid to improve the fixing of ink ejected onto the print medium 7 in the printer 1. The pretreatment agent is, for example, an aqueous solution containing metal salt, such as $CaCl_2$). The heat treatment portion 50 presses the print medium 7 at a high temperature and dries the pretreatment agent, thus improving the fixing of the pretreatment agent to the print medium 7 and improving image quality. The heat treatment portion 50 is provided with a press surface (not shown in the drawings), a press motor 20, a heater element 28 and the like. The heater element 28 heats the press surface. The press motor 20 moves the press surface up and down so that the print medium 7 is pressed by the press surface. Note that the heat treatment portion 50 need not necessarily be provided with the press surface. In this case, the heater element 28 heats the inside of the pretreatment device 10.

As shown in FIG. 2, the pretreatment device 10 is further provided with a CPU 11, a ROM 12, a RAM 13, a flash memory 14, drive circuits 16 and 19, an operation portion 22, a display portion 23, an input/output portion 24, a communication portion 25 and the like. The constitutions are mutually connected via a bus 26. The CPU 11 controls the pretreatment device 10, reads out various programs from the ROM 12, and performs various types of processing using the RAM 13 as a working memory.

The drive circuit 16 is connected to the platen motor 17, and drives the platen motor 17 under the control of the CPU 11. The drive circuit 19 is connected to the press motor 20 and the heater element 28, and drives the press motor 20 and the heater element 28 under the control of the CPU 11.

The operation portion 22 is provided with an operation panel and the like. An operator can give a desired command to the pretreatment device 10 via the operation portion 22. The display portion 23 is formed by a known display device and the like. The display portion 23 may be provided with a touch panel (not shown in the drawings) and may also function as the operation portion 22. The input/output portion 24 is provided with a secure digital (SD) memory card slot, a USB port, a serial port of another standard, and the like.

The communication portion 25 has at least one of a wireless module (not shown in the drawings) and a wired module (not shown in the drawings), and can mutually communicate with the printer 1, the terminal device 2 and the server 3 via the network 4. The pretreatment device 10 may be connected to the printer 1, the terminal device 2, the post-treatment device 5 and the server 3 via the network 4 by the wireless module connectable to the USB port, in place of the communication portion 25.

Further, the code reader 27 is connected to the CPU 11. The code reader 27 reads out platen identification information from the platen identification information portion 608 (to be described later) provided on the platen 6, and inputs the platen identification information to the CPU 31. The code reader 27 may be provided, for example, at a position at which the code reader 27 faces the platen identification information portion 608 provided on the platen 6 that is conveyed by the platen conveyance mechanism 90. Alternatively, the operator may hold the code reader 27 and read out the platen identification information from the platen identification information portion 608.

Configuration of Printer 1

Figure 3:
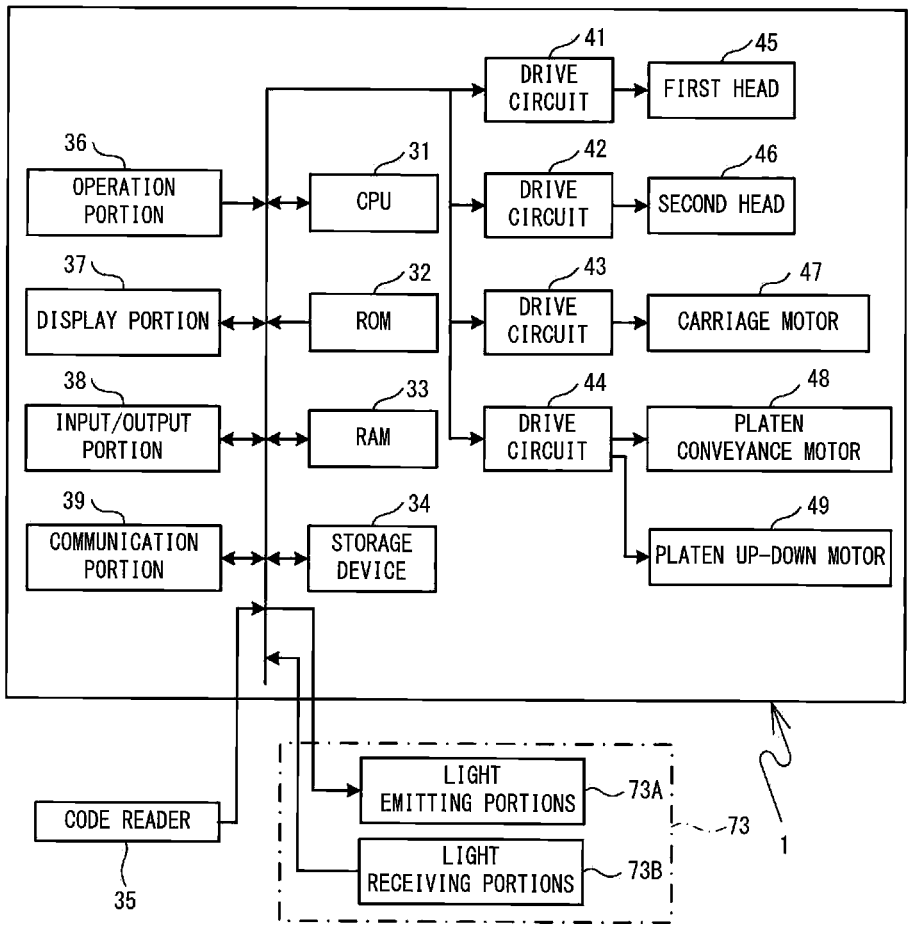
FIG. 3 is a block diagram showing an example of an electrical configuration of a printer 1.

As shown in FIG. 3, the printer 1 is provided with a CPU 31, a ROM 32, a RAM 33, a storage device 34, an operation portion 36, a display portion 37, an input/output portion 38, a communication portion 39, drive circuits 41 to 44, and the like. The constitutions are mutually connected via a bus. The CPU 31 controls the printer 1, reads out various programs from the ROM 32, and performs various types of processing using the RAM 33 as a working memory. For example, the CPU 31 reads out a print processing program from the ROM 32 and performs print processing. The storage device 34 is a nonvolatile storage device, such as a flash memory, an HDD or the like. The storage device 34 stores print data to be described later and various parameters etc.

The code reader 35 and a height sensor 73 are connected to the CPU 31. For example, the code reader 35 reads out the platen identification information from the platen identification information portion 608 (to be described later) provided on the platen 6, and inputs the platen identification information to the CPU 31. The code reader 35 may be provided, for example, at a position at which the code reader 35 faces the platen identification information portion 608 provided on the platen 6 that is conveyed by the platen conveyance mechanism 90. Alternatively, the operator may hold the code reader 35 and read out the platen identification information from the platen identification information portion 608. The height sensor 73 is an optical sensor that is formed by light emitting portions 73A and light receiving portions 73B, and detects the height of the print medium 7 placed on a top surface 611 of the platen 6. A pair of the light emitting portion 73A and the light receiving portion 73B are provided at positions at which they face each other in the horizontal direction. Further, the plurality of light emitting portions 73A are aligned in the up-down direction and the plurality of light receiving portions 73B are also aligned in the up-down direction so as to detect the height of the platen 6 that passes between them.

The operation portion 36 is provided with an operation panel and the like (not shown in the drawings). A command of the operator is input to the CPU 31 via the operation portion 36. The display portion 37 is formed by a known display device and the like. The display portion 37 may be provided with a touch panel (not shown in the drawings) and may also function as the operation portion 36. The input/output portion 38 is provided with an SD memory card slot, a USB port, a serial port of another standard, and the like.

The communication portion 39 has at least one of a wireless module (not shown in the drawings) and a wired module (not shown in the drawings), and can mutually communicate with the pretreatment device 10, the terminal device 2, the post-treatment device 5 and the server 3 via the network 4. The printer 1 may be connected to the pretreatment device 10, the terminal device 2, the post-treatment device 5 and the server 3 via the network 4 by the wireless module connectable to the USB port, in place of the communication portion 39.

The drive circuit 41 is connected to a first head 45, and causes droplets of color inks to be ejected from each of nozzles (not shown in the drawings) of the first head 45, under the control of the CPU 31. The drive circuit 42 is connected to a second head 46, and causes droplets of a white ink to be ejected from each of nozzles (not shown in the drawings) of the second head 46, under the control of the CPU 31. The drive circuit 43 is connected to a carriage motor 47, and drives the carriage motor 47 under the control of the CPU 31. The drive circuit 44 is connected to a platen conveyance motor 48 and a platen up-down motor 49, and drives the platen conveyance motor 48 and the platen up-down motor 49 under the control of the CPU 31.

Configuration of Post-Treatment Device 5

Figure 4:
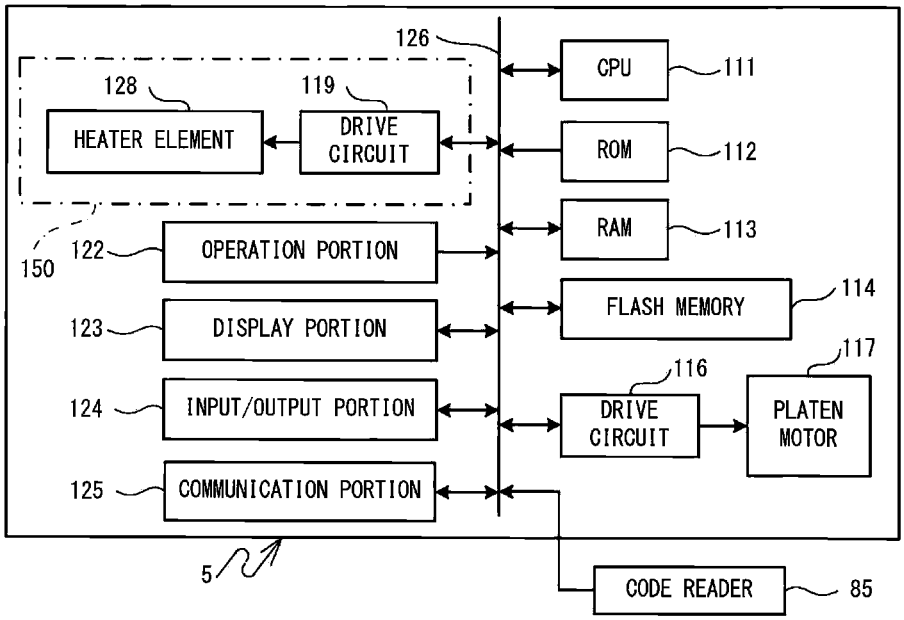
FIG. 4 is a block diagram showing an example of an electrical configuration of a post-treatment device 5.

As shown in FIG. 4, the post-treatment device 5 is provided with a heat treatment portion 150 and the like. The platen 6 on which the print medium 7 has been placed is conveyed to the heat treatment portion 150 by an internal platen conveyance mechanism (not shown in the drawings) that is formed by a platen motor 117 and the like. The platen motor 117 is a stepping motor, for example. The heat treatment portion 150 is provided with a heater element 128 and the like. The heater element 128 heats the print medium 7. Therefore, the heat treatment portion 150 dries the ink by heating the print medium 7 at a high temperature, and thus improves the fixing of the ink to the print medium 7.

As shown in FIG. 4, the post-treatment device 5 is further provided with a CPU 111, a ROM 112, a RAM 113, a flash memory 114, drive circuits 116 and 119, an operation portion 122, a display portion 123, an input/output portion 124, a communication portion 125 and the like, and they are mutually connected via a bus 126. The CPU 111 controls the post-treatment device 5, reads out various programs from the ROM 112, and performs various types of processing using the RAM 113 as a working memory. The flash memory 114 stores various parameters and the like.

The drive circuit 116 is connected to the platen motor 117, and drives the platen motor 117 under the control of the CPU 111. The drive circuit 119 is connected to the heater element 128, and drives the heater element 128 under the control of the CPU 111.

The operation portion 122 is provided with an operation panel and the like. The operator can give a desired command to the post-treatment device 5 via the operation portion 122. The display portion 123 is formed by a known display device and the like. The display portion 123 may be provided with a touch panel (not shown in the drawings) and may also function as the operation portion 122. The input/output portion 124 is provided with an SD memory card slot, a USB port, a serial port of another standard, and the like.

The communication portion 125 has at least one of a wireless module (not shown in the drawings) and a wired module (not shown in the drawings), and can mutually communicate with the pretreatment device 10, the printer 1, the terminal device 2 and the server 3 via the network 4. The post-treatment device 5 may be connected to the pretreatment device 10, the printer 1, the terminal device 2 and the server 3 via the network 4 by the wireless module connectable to the USB port, in place of the communication portion 125.

Further, the code reader 85 is connected to the CPU 111. For example, the code reader 85 reads out the platen identification information from the platen identification information portion 608 (to be described later) provided on the platen 6, and inputs the platen identification information to the CPU 111. The code reader 85 may be provided, for example, at a position at which the code reader 85 faces the platen identification information portion 608 provided on the platen 6 that is conveyed by the platen conveyance mechanism 90. Alternatively, the operator may hold the code reader 85 and read out the platen identification information from the platen identification information portion 608.

Electrical Configuration of Terminal Device 2

Figure 5:
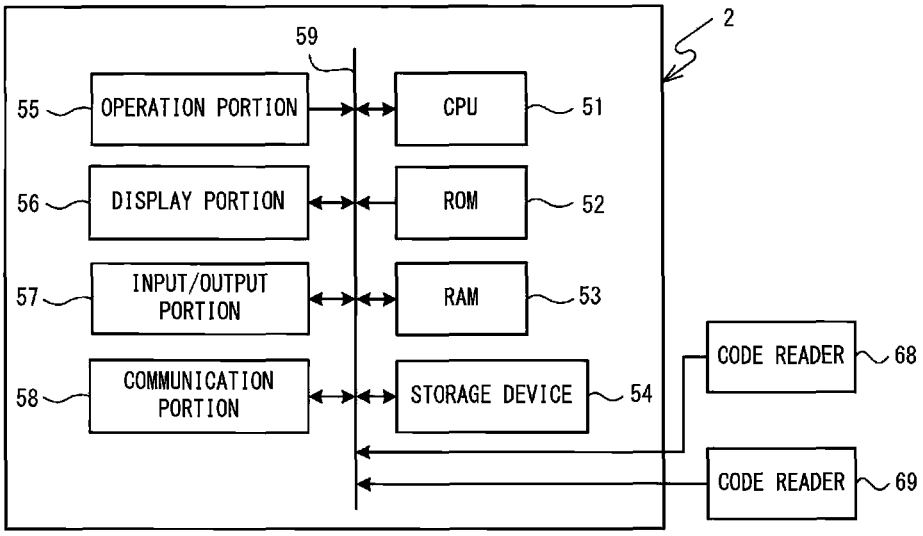
FIG. 5 is a block diagram showing an example of an electrical configuration of a terminal device 2.

The terminal device 2 is, for example, a personal computer (PC), a tablet, a smart phone or the like. As shown in FIG. 5, the terminal device 2 is provided with a CPU 51, a ROM 52, a RAM 53, a storage device 54, an operation portion 55, a display portion 56, an input/output portion 57, a communication portion 58 and the like, and they are mutually connected via a bus 59. The CPU 51 controls the terminal device 2, reads out various programs from the storage device 54, and performs various types of processing using the RAM 53 as a working memory. The storage device 54 stores various programs, various types of information and the like. The storage device 54 is, for example, a nonvolatile storage device, such as an HDD, a flash memory or the like.

The operation portion 55 is provided with a keyboard (not shown in the drawings) or an operation panel (including a touch panel) etc. A command of the operator is input to the CPU 51 via the operation portion 55. The display portion 56 is formed by a known display device and the like. The display portion 56 may be provided with a touch panel (not shown in the drawings) and may also function as the operation portion 55. The input/output portion 57 is provided with an SD memory card slot, a USB port, a serial port of another standard, and the like.

The communication portion 58 has at least one of a wireless module (not shown in the drawings) and a wired module (not shown in the drawings), and can mutually communicate with the pretreatment device 10, the printer 1, the post-treatment device 5 and the server 3 via the network 4. The terminal device 2 may be connected to the pretreatment device 10, the printer 1, the post-treatment device 5 and the server 3 via the network 4 by the wireless module connectable to the USB port, in place of the communication portion 58.

Further, a code reader 68 and a code reader 69 are connected to the CPU 51. For example, the code reader 68 reads out the platen identification information from the platen identification information portion 608 (to be described later) provided on the platen 6, and inputs the platen identification information to the CPU 51. The code reader 68 may be provided, for example, at a position at which the code reader 68 faces the platen identification information portion 608 provided on the platen 6, in the mounting position 90A of the platen conveyance mechanism 90. Alternatively, the operator may hold the code reader 68 and read out the platen identification information from the platen identification information portion 608. For example, the code reader 69 reads out print medium information 71 (refer to FIG. 11 and FIG. 12), to be described later, that is attached to the print medium 7, and inputs the print medium information 71 to the CPU 51. The operator may hold the code reader 69 and read out the print medium information 71.

Electrical Configuration of Server 3

Figure 6:
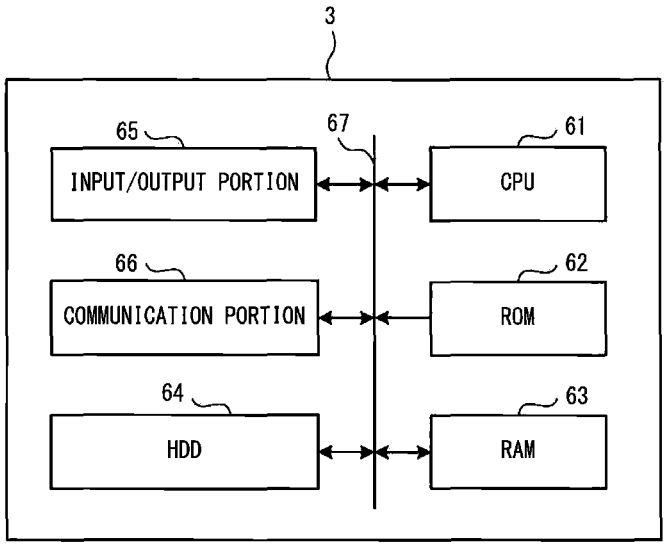
FIG. 6 is a block diagram showing an example of an electrical configuration of a server 3.

As shown in FIG. 6, the server 3 is provided with a CPU 61, a ROM 62, a RAM 63, an HDD 64, an input/output portion 65, a communication portion 66 and the like, and they are mutually connected via a bus 67. The CPU 61 controls the server 3, reads out various programs from the HDD 64, and performs various types of processing using the RAM 63 as a working memory. The HDD 64 stores various tables, such as an association table 80, a first table 81, a second table 82 and a third table that will be described later, various programs, various types of information and the like.

The communication portion 66 has at least one of a wireless module (not shown in the drawings) and a wired module (not shown in the drawings), and can mutually communicate with the pretreatment device 10, the printer 1, the post-treatment device 5 and the terminal device 2 via the network 4. The server 3 may be connected to the pretreatment device 10, the printer 1, the post-treatment device 5 and the terminal device 2 via the network 4 by the wireless module connectable to the USB port, in place of the communication portion 66.

Association Table 80

As shown in FIG. 7, the association table 80 is a table in which the platen identification information, the print medium information, error information, processing completion information, the print data and height information are associated with each other. The HDD 64 of the server 3 stores the association table 80. For example, the platen identification information and the print medium information that are associated with each other by processing at step S4 of main processing to be described later are stored in the association table 80.

First Table 81

As shown in FIG. 8, the first table 81 is a table in which the print medium information and pretreatment conditions are associated with each other. For example, the HDD 64 of the server 3 stores the first table 81. The pretreatment conditions include application conditions relating to application treatment, and heat conditions relating to heat treatment. The application conditions are, for example, an application amount per unit area (mg/cm$^2$), an application range and a type of the pretreatment agent. The application amount per unit area (mg/cm$^2$) is information indicating an application amount per unit area (mg/cm$^2$) of the pretreatment agent. The application range is information indicating a range over which the pretreatment agent is applied. The type of the pretreatment agent is information indicating the type of the pretreatment agent.

The heat treatment conditions include, for example, a heat treatment pressure (N/cm$^2$), a heat treatment time period (sec), a heat treatment temperature (° C.), a heat treatment range, and a number of times of the heat treatment. When the heat treatment portion 50 is a heat press portion, a heat roller or the like and applies a pressure to the print medium 7 that is a heat treatment target, the heat treatment pressure (N/cm$^2$) is a value of the pressure applied at the time of the heat treatment. Therefore, when the heat treatment portion 50 is a near-infrared ray oven, an air blowing device or the like and does not come into contact with the print medium 7, the heat treatment pressure is set to null (–). The heat treatment time period (sec) is a time period during which the heat treatment is performed. The heat treatment temperature (° C.) is a temperature of the heat treatment. The heat treatment range is a range over which the heat treatment is performed. The number of times of the heat treatment is the number of times that the heat treatment of the set heat treatment time period (sec) is repeated.

Second Table 82

As shown in FIG. 9, the second table 82 is a table in which the print medium information and the print data are associated with each other. For example, the HDD 64 of the server 3 stores the second table 82.

Third Table 83

As shown in FIG. 10, the third table 83 is a table in which the print medium information and post-treatment conditions are associated with each other. The post-treatment conditions are, for example, heat treatment conditions relating to the heat treatment, and are the heat treatment time period (sec) and the heat treatment temperature (° C.). For example, the HDD 64 of the server 3 stores the third table 83.

Configuration of Platen 6

Figure 11A:
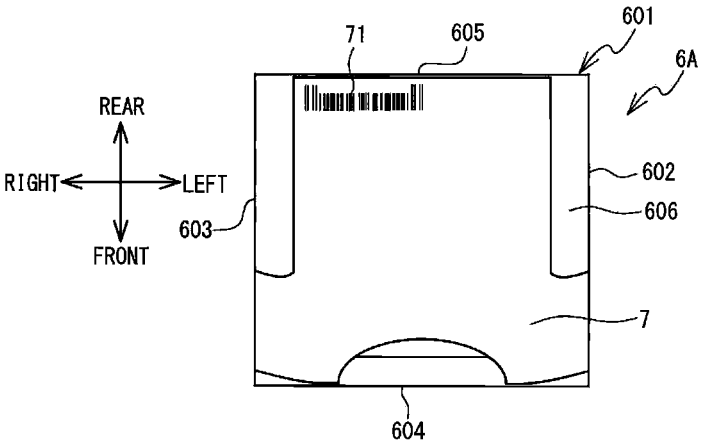
FIG. 11 (A) is a plan view showing a platen 6A, FIG. 11 (B) is a left side view of the platen 6A, and FIG. 11 (C) is a front view of the platen 6A.
Figure 11B:
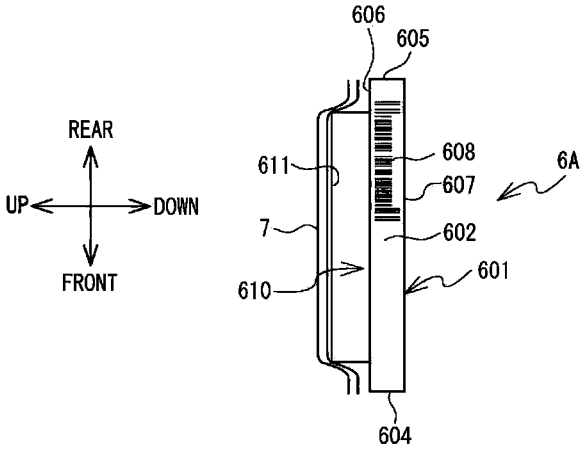
Figure 11C:
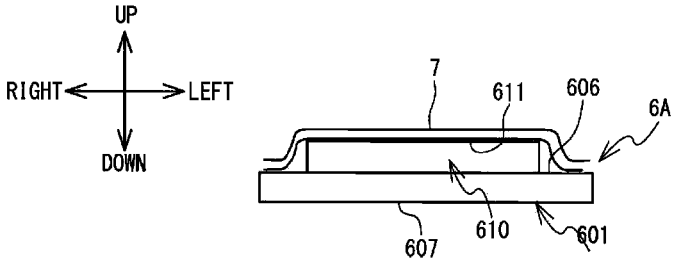

Next, a platen 6A, which is a first working example of the platen 6, will be explained with reference to FIG. 11. FIG. 11 (A) to FIG. 11 (C) each show a state in which the print medium 7 is placed on the platen 6A. The platen 6A is used in the pretreatment device 10, the printer 1 and the post-treatment device 5. The platen 6A is provided with a lower plate portion 601 and an upper plate portion 610. The lower plate portion 601 is a rectangular plate member, and is provided with a left side surface 602, a right side surface 603, a front surface 604, a rear surface 605, an upper surface 606 and a lower surface 607. Further, the upper plate portion 610 is provided on the upper surface 606 of the lower plate portion 601. The upper plate portion 610 is a rectangular plate member that is smaller than the lower plate portion 601, and is provided with the top surface 611. The top surface 611 supports the tubular print medium 7, which is a double layer in the up-down direction, from below.

As shown in FIG. 11 (B), the platen identification information portion 608 is provided on the left side surface 602 of the lower plate portion 601. The platen identification information portion 608 is associated with processing in the pretreatment device 10, the post-treatment device 5 or the printer 1, and indicates the platen identification information that identifies the platen 6A. As the platen identification information, pieces of identification information that do not overlap with each other are used in a process of the print processing system 100. Therefore, in the process of the print processing system 100, the platen identification information is unique. The platen identification information also includes platen information, such as a size of the top surface 611 of the platen 6A, a height from the lower surface 607 to the top surface 611 of the platen 6A, and information of the platen 6A. A predetermined clearance is required between nozzle surfaces of the first head 45 and the second head 46 of the printer 1 and the print medium 7 placed on the top surface 611 of the platen 6A. Further, a range within which the printer 1 can move the platen 6 up and down is defined. Therefore, the height of the platen that can be used in the printer 1 is limited, and the printer 1 needs to obtain the information of the height of the platen 6. Further, for example, the platen identification information portion 608 indicates information of a one-dimensional code, such as a bar code, a two-dimensional code, such as a QR code, or a three-dimensional code. It is necessary to provide the platen identification information portion 608 at a position at which it is not covered by the print medium 7 hanging down. More specifically, in a state in which the print medium 7 is set on the platen 6A, it is necessary for the platen identification information portion 608 to be provided at a position at which each of the code readers 68, 27, 35 and 85 can read out the platen identification information. For example, the platen identification information portion 608 is provided on the lower plate portion 601 that is further to the outside than the top surface 611 of the upper plate portion 610 when viewed from above.

Figure 12A:
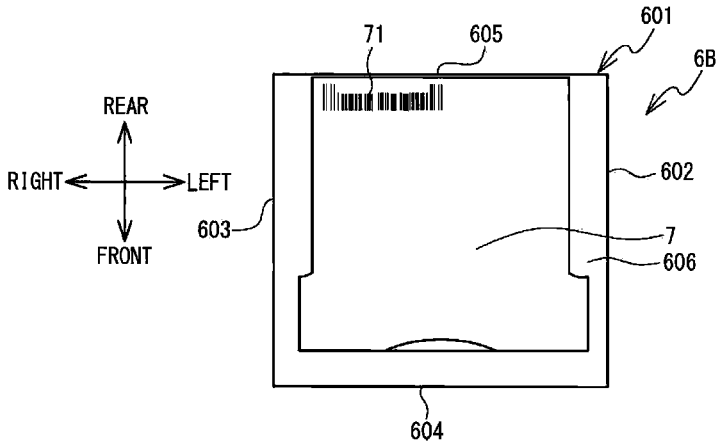
FIG. 12 (A) is a plan view showing a platen 6B, FIG. 12 (B) is a left side view of the platen 6B, and FIG. 12 (C) is a front view of the platen 6B.
Figure 12B:
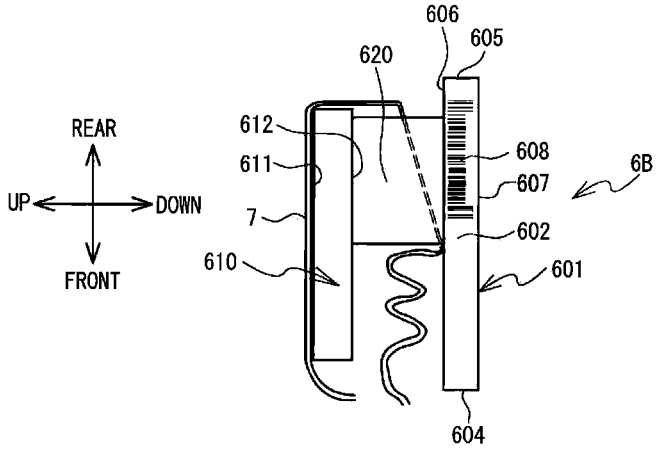
Figure 12C:
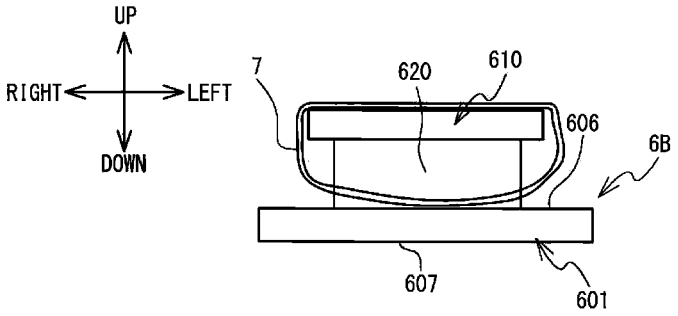
Figure 13:
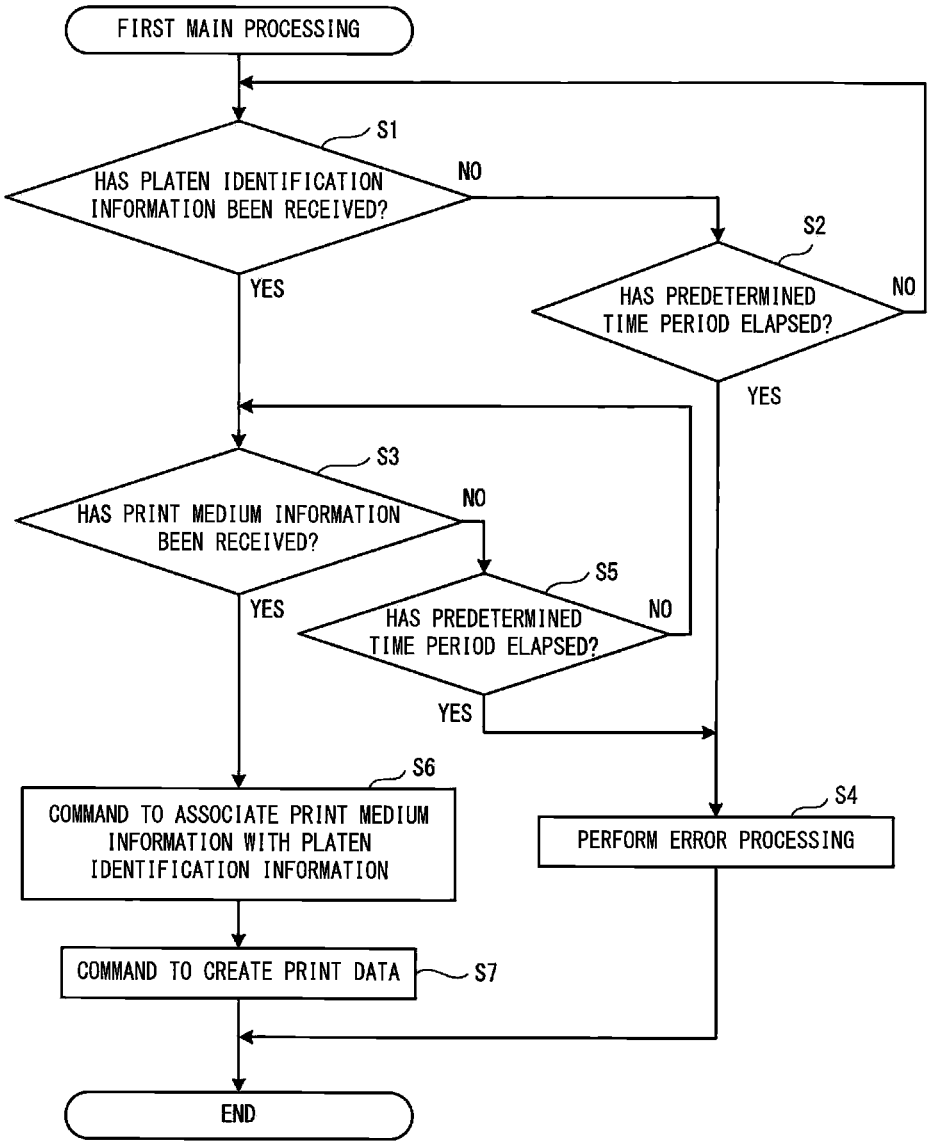
FIG. 13 is a flowchart of first main processing.

A platen 6B, which is a second working example of the platen 6, will be explained with reference to FIG. 12. Note that an explanation of a configuration that is similar to that of the first working example is omitted here. FIG. 12 (A) to FIG. 12 (C) each show a state in which the print medium 7 is placed on the platen 6B. The platen 6B is provided with the lower plate portion 601, a connection portion 620 and the upper plate portion 610, in that order from below. The upper plate portion 610 and the lower plate portion 601 are the same plate members as those of the platen 6A. Even in a form in which the print medium 7 is caused to be worn on the upper plate portion 610, the top surface 611 supports a print surface of the tubular print medium 7 from below. The lower plate portion 601 and the upper plate portion 610 are separated from each other by a certain distance. The connection portion 620 connects the lower plate portion 601 and the upper plate portion 610. The connection portion 620 is a cuboid member having a predetermined height in the up-down direction, and is provided between a rear portion side of the upper surface 606 of the lower plate portion 601 and a rear portion side of the lower surface 612 of the upper plate portion 610.

As shown in FIG. 12 (B), the platen identification information portion 608 is provided on the left side surface 602 of the lower plate portion 601. The platen identification information portion 608 indicates the platen identification information that identifies the platen 6B in the same manner as the platen identification information portion 608 of the platen 6A. The platen identification information portion 608 is provided on the lower plate portion 601 that is different from the upper plate portion 610 that supports the print medium 7. Therefore, the possibility is reduced that the platen identification information portion 608 is covered by the print medium 7 hanging down. In the explanation below, the platens 6A and 6B are also collectively referred to as the "platen 6."

As shown in FIG. 11 and FIG. 12, the print medium information 71 is attached to the print medium 7 that is placed on the platen 6. The print medium information 71 is identification information that can identify the print medium 7, such as a cloth. The print medium information 71 is, for example, information of a one-dimensional code, such as a bar code, a two-dimensional code, such as a QR code, or a three-dimensional code. As will be described later, the CPUs 11, 31 and 111 acquire the application conditions, the heat treatment conditions, print conditions, the post-treatment conditions and the like from the server 3 on the basis of the print medium information 71 associated with the platen identification information.

Main Processing

A flow of first main processing to fourth main processing will be explained with reference to FIG. 13 to FIG. 16. The first main processing is performed by the CPU 51 of the terminal device 51, the second main processing is performed by the CPU 11 of the pretreatment device 10, the third main processing is performed by the CPU 31 of the printer 1, and the fourth main processing is performed by the CPU 111 of the post-treatment device 5. The first main processing will be explained with reference to FIG. 13. The CPU 51 of the terminal device 2 reads out a first main processing program from the ROM 52, and performs the first main processing using the RAM 53 as the working memory. The first main processing is started, for example, by being triggered by turning on a power source of the terminal device 2. The CPU 51 determines whether the platen identification information has been received (step S1). When the platen identification information read out by the code reader 68 is input to the CPU 51, the CPU 51 determines that the platen identification information has been received (yes at step S1). When the platen identification information has not been received (no at step S1), when a predetermined time period has not elapsed (no at step S2), the CPU 51 returns the processing to step S1. When the predetermined time period has elapsed (yes at step S2), the CPU 51 performs error processing (step S4). For example, the CPU 51 causes the display portion 56 to display the fact that the platen identification information has not been received.

When the CPU 51 determines that the platen identification information has been received (yes at step S1), the CPU 51 determines whether the print medium information 71 has been received (step S3). When the print medium information 71 read out by the code reader 69 is input to the CPU 51, the CPU 51 determines that the print medium information has been received (yes at step S3). When the print medium information 71 has not been received (no at step S3), when a predetermined time period has not elapsed (no at step S5) from when the platen identification information is received (yes at step S1), the CPU 51 returns the processing to step S3. When the predetermined time period has elapsed (yes at step S5), the CPU 51 performs the error processing (step S4). For example, the CPU 51 causes the display portion 56 to display the fact that the print medium information 71 has not been received. Note that the reception of the platen identification information and the reception of the print medium information may be reversed in order.

When the CPU 51 determines that the print medium information has been received (yes at step S3), the CPU 51 transmits an association command to associate the print medium information with the platen identification information, to the server 3 via the communication portion 58 (step S6). The CPU 61 of the server 3 that has received the association command stores a correspondence relationship between the platen identification information and the print medium information in the association table 80 shown in FIG. 7. Next, the CPU 51 transmits a command to create the print data to the server 3 via the communication portion 58, together with the platen identification information (step S7). The CPU 61 of the server 3 that has received the command to create the print data identifies the print medium information corresponding to the platen identification information from the association table 80. Next, the CPU 61 acquires the print data corresponding to the identified print medium information from the second table 82 shown in FIG. 9. On the basis of the print data (a print original image and print setting information) corresponding to the print medium information, the CPU 61 starts to create the print data of raster data. When the print data of the raster data is complete, the CPU 61 transmits the print data to the printer 1, together with the platen identification information. The CPU 31 of the printer 1 stores, in the storage device 34, the print data received corresponding to the platen identification information. Further, the server 3 stores the complete print data in correspondence with the platen identification information of the association table 80. Then, the CPU 11 ends the first main processing.

Figure 14:
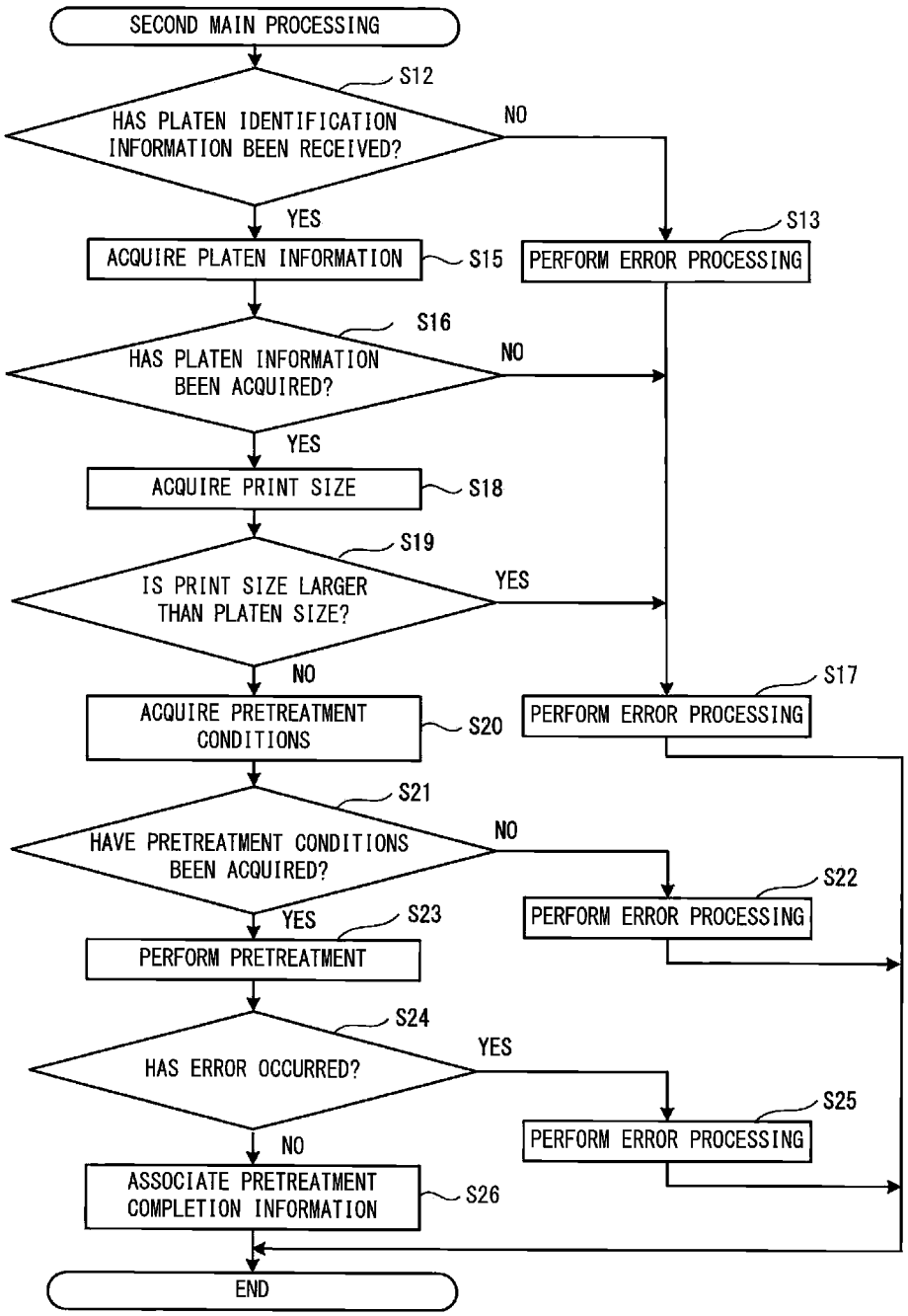
FIG. 14 is a flowchart of second main processing.

The second main processing will be explained with reference to FIG. 14. The CPU 11 of the pretreatment device 10 reads out a second main processing program from the ROM 12, and performs the second main processing using the RAM 13 as the working memory. The second main processing is started, for example, by being triggered by turning on a power source of the pretreatment device 10. When the platen 6 is conveyed to the pretreatment device 10 by the platen conveyance mechanism 90, the CPU 11 of the pretreatment device 10 determines whether the platen identification information has been received (step S12). When the platen identification information of the platen 6 read out by the code reader 27 is input to the CPU 11, the CPU 11 determines that the platen identification information has been received (yes at step S12). For example, when the CPU 11 determines that the platen identification information has not been received (no at step S12) even after a predetermined time period has elapsed from when the platen information is received (yes at step S1) in the first main processing, the CPU 11 performs error processing (step S13). For example, the CPU 11 does not perform the pretreatment (step S23) on the print medium 7 placed on the platen 6, and causes the platen conveyance mechanism 90 to transfer the platen 6 to the printer 1.

Next, when the CPU 11 determines "YES" in the determination at step S12, the CPU 11 acquires the platen information on the basis of the platen identification information (step S15). The platen identification information includes the platen information, such as the platen size, the platen height, the platen material and the like. The CPU 11 determines whether the platen information has been acquired from the platen identification information (step S16). When the CPU 11 determines that the platen information has not been acquired (no at step S16), the CPU 11 performs error processing (step S17). The CPU 11 transmits a command to perform the error processing to the server 3, together with the platen identification information. As the error processing, the CPU 61 of the server 3 associates error information indicating that the platen information has not been acquired with the error information of the association table 80. Further, the CPU 11 does not perform the pretreatment (step S23) on the print medium 7 placed on the platen 6, and causes the platen conveyance mechanism 90 to transfer the platen 6 to the printer 1.

When the platen information has been acquired (yes at step S16), the CPU 11 acquires the print size (step S18). For example, the CPU 11 transmits a command to the server 3 to request the print size, together with the platen identification information (step S18). The CPU 61 of the server 3 identifies the print medium information corresponding to the platen identification information from the association table 80. Next, the CPU 61 acquires the print data corresponding to the identified print medium information from the second table 82 shown in FIG. 9. Next, the CPU 61 identifies the print size from the print data, and transmits the print size to the pretreatment device 10 via the communication portion 66.

The CPU 11 determines whether the print size is larger than the platen size (step S19). When the CPU 11 determines that the print size is larger than the platen size (yes at step S19), the CPU 11 performs the error processing (step S17). Hereinafter, the error that the print size is larger than the platen size is referred to as a "platen size error." For example, the CPU 61 of the server 3 associates the error information of the "platen size error" with platen identification information PID1 of the association table 80. Next, the CPU 11 does not cause the pretreatment device 10 to perform the pretreatment (step S23), and causes the platen conveyance mechanism 90 to transfer the platen 6 to the printer 1.

When the CPU 11 determines that the print size is not larger than the platen size (no at step S19), the CPU 11 acquires the pretreatment conditions (step S20). For example, the CPU 11 transmits a command to the server 3 to request the pretreatment conditions, together with the platen identification information received by the processing at step S12 (step S20). The CPU 61 of the server 3 identifies the print medium information corresponding to the platen identification information, from the association table 80. Next, for example, the CPU 61 identifies print medium information ID1 corresponding to the platen identification information PID1 of the association table 80. Next, in the first table 81, the CPU 61 identifies the pretreatment conditions corresponding to the print medium information ID1. For example, the pretreatment conditions to be identified are the application conditions and the heat treatment conditions. The CPU 61 transmits the identified pretreatment conditions to the pretreatment device 10 via the communication portion 66. When the CPU 61 cannot identify the pretreatment conditions, the CPU 61 transmits information indicating that there are no pretreatment conditions to the pretreatment device 10.

Next, the CPU 11 determines whether the pretreatment conditions have been acquired (step S21). When the pretreatment conditions cannot be acquired (no at step S21), the CPU 11 performs error processing (step S22). An example of when the pretreatment conditions cannot be acquired is when the code reader 27 receives the platen identification information not associated with the print medium information; that is, when the CPU 11 receives information indicating that there is no pretreatment conditions from the server 3. Hereinafter, the error that the pretreatment conditions cannot be acquired is referred to as a "pretreatment conditions non-acquisition error." The CPU 11 transmits a command to the server 3 to perform the error processing, together with the platen identification information. As the error processing, the CPU 61 of the server 3 associates the error information of the "pretreatment conditions non-acquisition error" with the error information of the association table 80. Further, the CPU 11 does not perform the pretreatment on the print medium 7 placed on the platen 6, and causes the platen conveyance mechanism 90 to transfer the platen 6 to the printer 1.

When the pretreatment conditions have been acquired (yes at step S21), the CPU 11 performs the pretreatment in the pretreatment device 10 in accordance with the application conditions and the heat treatment conditions, which are the acquired pretreatment conditions (step S23). In the processing at step S23, when the CPU 11 determines that an error, such as an error that the pretreatment cannot be completed, has occurred (yes at step S24), the CPU 11 performs error processing (step S25). The CPU 11 transmits a command to the server 3 to perform the error processing, together with the platen identification information. As the error processing, the CPU 61 of the server 3 associates the error information of a "pretreatment error" with the error information of the association table 80. Further, the CPU 11 does not perform the pretreatment on the print medium 7 placed on the platen 6 (step S22), and causes the platen conveyance mechanism 90 to transfer the platen 6 to the printer 1.

When the pretreatment is complete and the error has not occurred (no at step S24), the CPU 11 transmits pretreatment completion information to the server 3, together with the platen identification information (step S26). That is, the CPU 61 of the server 3 associates the pretreatment completion information, which indicates that the pretreatment is complete, with the platen identification information of the association table 80 (step S26). Then, the CPU 11 ends the second main processing.

Figure 15:
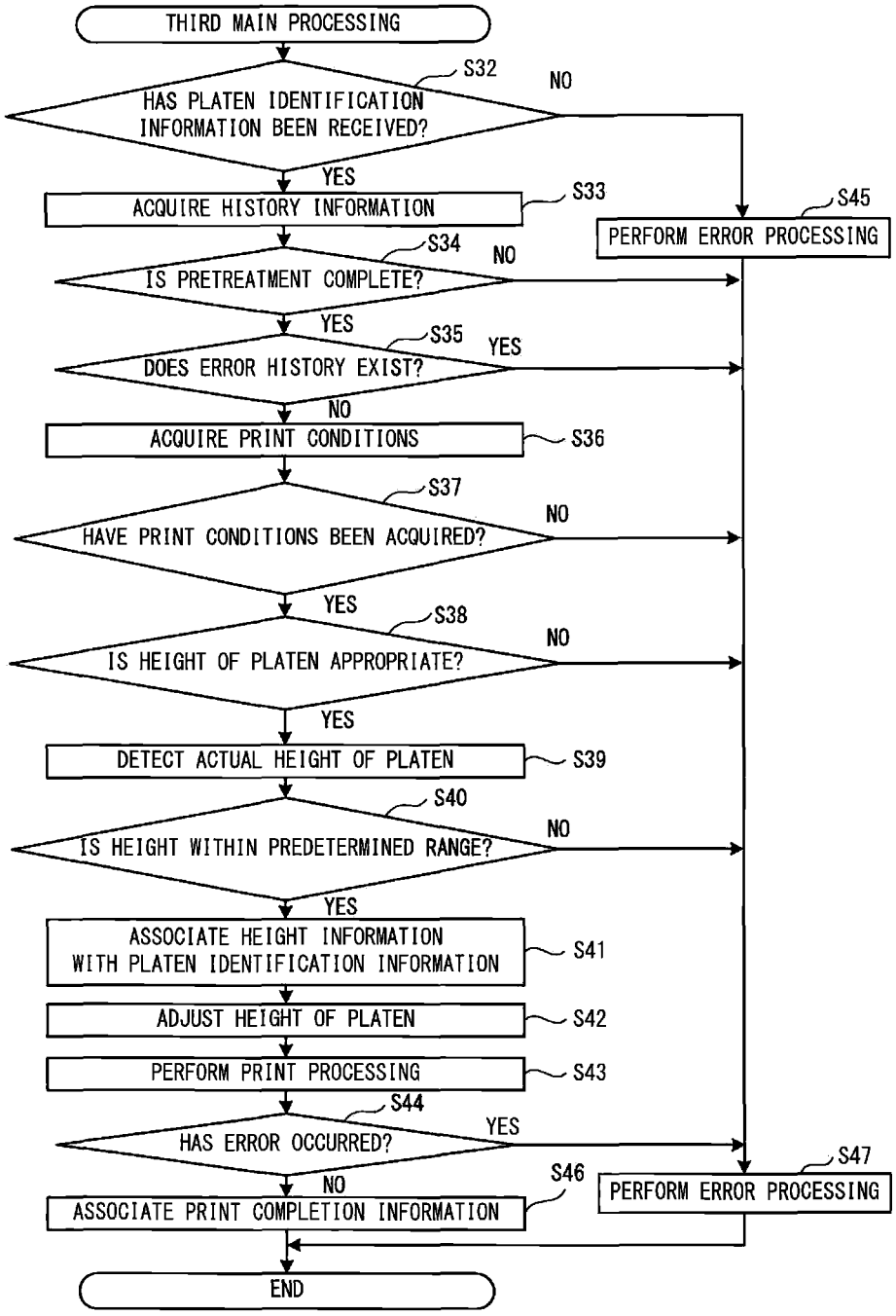
FIG. 15 is a flowchart of third main processing.

The third main processing will be explained with reference to FIG. 15. The CPU 31 of the printer 1 reads out a third main processing program from the ROM 32, and performs the third main processing using the RAM 33 as the working memory. The third main processing is started, for example, by being triggered by turning on a power source of the printer 1. When the platen 6 is conveyed to the printer 1 by the platen conveyance mechanism 90, the CPU 31 of the printer 1 determines whether the platen identification information has been received (step S32). For example, when the platen identification information of the platen 6 read out by the code reader 35 is input to the CPU 31, the CPU 31 determines that the platen identification information has been received (yes at step S32). When the CPU 31 determines that the platen identification information has not been received even after a predetermined time period has elapsed (no at step S32), the CPU 31 performs error processing (step S45). For example, the CPU 31 does not perform the print processing (step S43) on the print medium 7 placed on the platen 6, and causes the platen conveyance mechanism 90 to transfer the platen 6 to the post-treatment device 5. When the platen identification information has been received (yes at step S32), the CPU 31 acquires history information (step S33). For example, the CPU 31 transmits a request to the server 3 to acquire the history information, together with the platen identification information received by the processing at step S32 (step S33). Examples of the history information include the pretreatment completion information and the error information. The CPU 61 of the server 3 identifies, from the association table 80, the pretreatment completion information and the error information that correspond to the platen identification information. The CPU 61 transmits the identified pretreatment completion information and error information to the printer 1 via the communication portion 66. When the pretreatment completion information and the error information cannot be identified, the CPU 61 transmits, to the printer 1, information indicating that there is no pretreatment completion information or information indicating that there is no error information.

Next, the CPU 31 determines whether the pretreatment is complete (step S34). When the pretreatment completion information is received from the server 3, the CPU 31 determines that the pretreatment is complete (yes at step S34). When the information indicating that there is no pretreatment completion information is received, the CPU 31 determines that the pretreatment is not complete (no at step S34), and performs error processing (step S47). Hereinafter, the error that the pretreatment is not complete is referred to as a "pretreatment non-completion error." The CPU 31 transmits a command to perform the error processing to the server 3, together with the platen identification information. As the error processing, the CPU 61 of the server 3 associates the error information of the "pretreatment non-completion error" with the error information of the association table 80. Further, the CPU 31 does not perform the print processing (step S43) on the print medium 7 placed on the platen 6, and causes the platen conveyance mechanism 90 to transfer the platen 6 to the post-treatment device 5.

When the pretreatment completion information is received from the server 3, the CPU 31 determines that the pretreatment is complete (yes at step S34). Next, the CPU 31 determines whether an error history exists (step S35). For example, when the CPU 31 receives the error information from the server 3, the CPU 31 determines that the error history exists (yes at step S35), and performs the error processing (step S47).

When the CPU 31 receives the information indicating that there is no error information from the server 3, the CPU 31 determines that the error history does not exist (no at step S35). Next, the CPU 31 acquires the print conditions associated with the platen identification information (step S36). An example of the print conditions is the print data whose creation is commanded by CPU 51 by the processing at step S7 of the first main processing and which is transmitted from the server 3 to the printer 1. Therefore, on the basis of the platen identification information, the CPU 31 acquires the print data stored in the storage device 34 (step S36). When the print data corresponding to the platen identification information does not exist in the storage device 34, the CPU 31 transmits, to the server 3, the platen identification information and a transmission request signal of the print data. When the print data corresponding to the platen identification information exists in the association table 80 of the HDD 64, the CPU 61 of the server 3 transmits the print data to the printer 1 via the communication portion 66. When the CPU 61 cannot identify the print data, the CPU 61 transmits information indicating no print data to the printer 1. Next, the CPU 31 determines whether the print conditions have been successfully acquired (step S37). When the CPU 31 acquires the print data from the storage device 34, or when print data is received from the server 3, the CPU 31 determines that the print conditions have been successfully acquired. When the print conditions have not been successfully acquired (no at step S37), the CPU 31 performs the error processing (step S47). An example of when the print conditions cannot be successfully acquired is when the CPU 31 receives information indicating no print data from the server 3.

When the CPU 31 has successfully acquired the print conditions (yes at step S37), the CPU 31 determines whether the height of the platen 6 is appropriate (step S38). For example, when there are two types of platens having different heights, the CPU 31 determines whether the height of the platen 6 to be used conforms to the print conditions, on the basis of the platen identification information and the print conditions. When the CPU 31 determines that the height of the platen 6 is not appropriate (no at step S38), the CPU 31 performs the error processing (step S47). When the CPU 31 determines that the platen height is appropriate (yes at step S38), the CPU 31 detects an actual height of the platen 6 (step S39). For example, the CPU 31 uses the height sensor 73 and detects the height of the platen 6 including the print medium 7 placed on the top surface 611 of the platen 6. Next, the CPU 31 determines whether the detected height is within a predetermined range (step S40). In the printer 1, the range over which the height of the platen 6 can be adjusted in the up-down direction is a predetermined range, for example, the range is ±5 mm in the up-down direction. Therefore, when the height detected by the height sensor 73 is not within the predetermined range (no at step S40), the CPU 31 performs the error processing (step S47).

When the CPU 31 determines that the height detected by the height sensor 73 is within the predetermined range (yes at step S40), the CPU 31 transmits a command to store the height information detected by the height sensor 73 in association with the platen identification information, to the server 3 via the communication portion 39 (step S41). The CPU 61 of the server 3 stores the height information corresponding to the platen identification information of the association table 80. The CPU 31 performs height adjustment of the platen 6 (step S42). For example, on the basis of the height information detected by the height sensor 73, the CPU 31 drives the platen up-down motor 49 and adjusts the height of the platen 6 to a height that conforms to the print conditions. Next, the CPU 31 performs the print processing by ejecting the ink from the first head 45 and the second 46 onto the print medium 7 placed on the platen 6 (step S43). The process of S41 may be after the process of S42.

When the CPU 31 determines that an error, such as an error that the print processing cannot be completed, has occurred in the processing at step S43 (yes at step S44), the CPU 31 performs the error processing (step S47). The CPU 31 transmits a command to the server 3 to perform the error processing, together with the platen identification information. As the error processing, the CPU 61 of the server 3 associates the error information of the print processing error with the error information of the association table 80. Further, the CPU 31 does not perform the print processing (step S43) on the print medium 7 placed on the platen 6, and causes the platen conveyance mechanism 90 to transfer the platen 6 to the post-treatment device 5.

When the CPU 31 determines that the error has not occurred in the print processing (no at step S44), the CPU 31 associates print completion information indicating the completion of the print processing with the platen identification information (step S46). For example, the CPU 31 transmits the print completion information to the server 3, together with the platen identification information (step S46). The CPU 61 of the server 3 associates the print completion information indicating the completion of the print processing with the platen identification information of the association table 80 (step S46). Then, the CPU 31 ends the third main processing.

Figure 16:
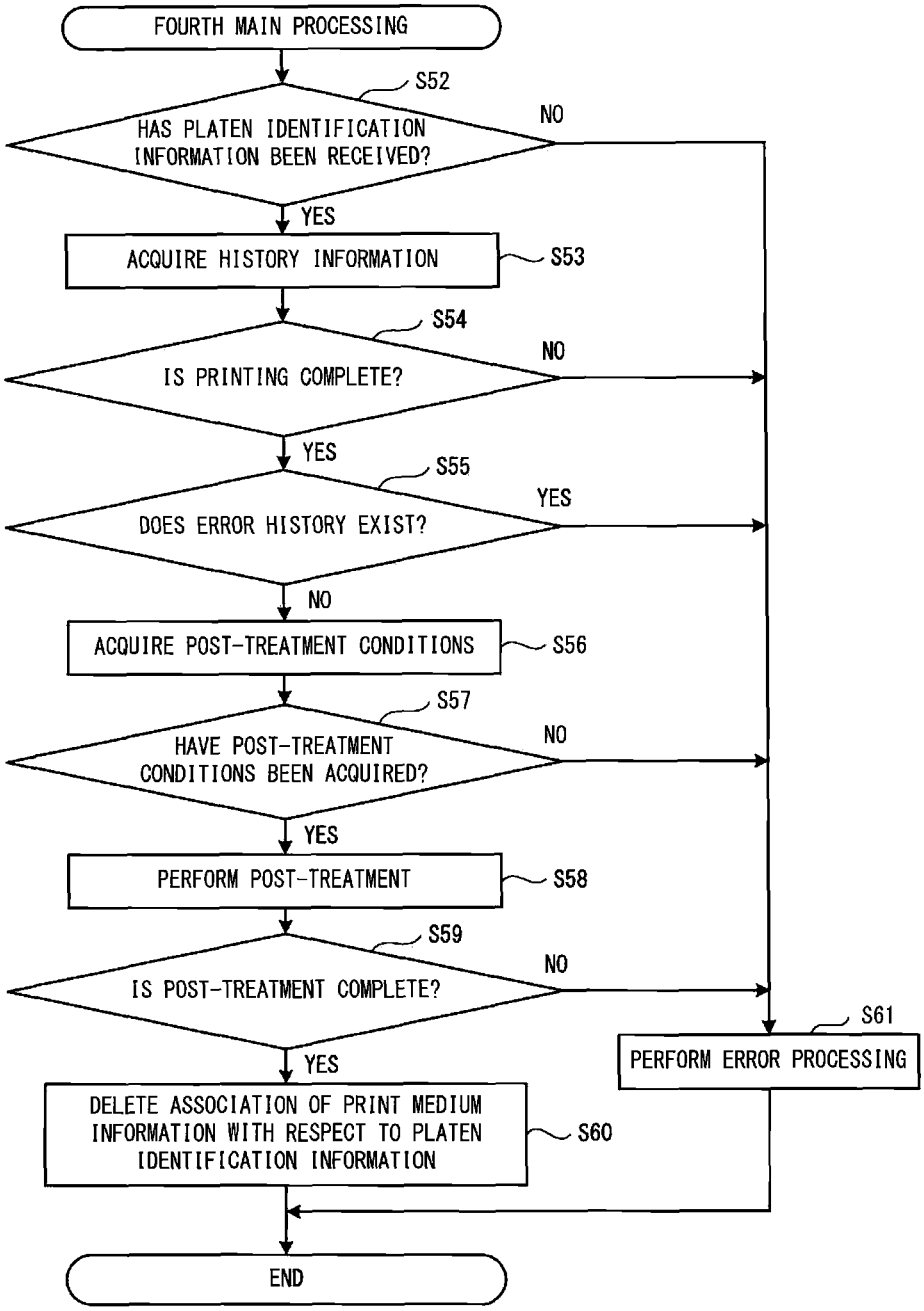
FIG. 16 is a flowchart of fourth main processing.

The fourth main processing will be explained with reference to FIG. 16. The CPU 111 of the post-treatment device 5 reads out a fourth main processing program from the ROM 112, and performs the fourth main processing using the RAM 113 as the working memory. The fourth main processing is started, for example, by being triggered by turning on a power source of the post-treatment device 5. The CPU 111 determines whether the platen identification information has been received (step S52). For example, when the platen identification information of the platen 6 read out by the code reader 85 is input to the CPU 111, the CPU 111 determines that the platen identification information has been received (yes at step S52). When the CPU 111 determines that the platen identification information has not been received even after a predetermined time period has elapsed (no at step S52), the CPU 111 performs error processing (step S61). The CPU 111 does not perform the post-treatment (step S58) on the print medium 7 placed on the platen 6, and causes the platen conveyance mechanism 90 to transfer the platen 6 to the detachment position 90B.

When the CPU 111 determines that the platen identification information has been received (yes at step S52), the CPU 111 acquires the history information (step S53). For example, the CPU 111 transmits, to the server 3, a request to acquire the history information, together with the platen identification information received by the processing at step S52 (step S53). Examples of the history information include the print completion information and the error information. The CPU 61 of the server 3 identifies, from the association table 80, the print completion information and the error information that correspond to the platen identification information. The CPU 61 transmits the identified print completion information and error information to the post-treatment device 5 via the communication portion 66. When the print completion information and the error information cannot be identified, the CPU 61 transmits, to the post-treatment device 5, information indicating that there is no print completion information or information indicating that there is no error information.

Next, the CPU 111 determines whether the printing is complete (step S54). When the information indicating that there is no print completion information is received (no at step S54), the CPU 111 determines that the printing is not complete (no at step S54), and performs the error processing (step S61). Hereinafter, the error that the printing is not complete is referred to as a "print non-completion error." The CPU 111 transmits a command to the server 3 to perform the error processing, together with the platen identification information. As the error processing, the CPU 61 of the server 3 associates the error information of the "print non-completion error" with the error information of the association table 80. Further, the CPU 111 does not cause the post-treatment device 5 to perform the post-treatment (step S58), and causes the platen conveyance mechanism 90 to transfer the platen 6 to the detachment position 90B.

When the print completion information is received from the server 3, the CPU 111 determines that the printing is complete (yes at step S54). Next, the CPU 111 determines whether the error history exists (step S55). For example, when the CPU 111 receives the error information from the server 3, the CPU 111 determines that the error history exists (yes at step S55), and performs the error processing (step S61).

Next, when the CPU 111 receives the information indicating that there is no error information from the server 3, the CPU 111 determines that the error history does not exist (no at step S55). Next, the CPU 111 acquires the post-treatment conditions (step S56). For example, the CPU 11 transmits a command to the server 3 to request the post-treatment conditions, together with the platen identification information received by the processing at step S52 (step S56). The CPU 61 of the server 3 identifies, from the association table 80, the print medium information corresponding to the platen identification information. For example, the CPU 61 identifies print medium information ID3 corresponding to platen identification information PID3 of the association table 80. Next, in the third table 83, the CPU 61 identifies the post-treatment conditions corresponding to the print medium information ID3. The post-treatment conditions are, for example, the heat treatment time period and the heat treatment temperature. The CPU 61 transmits the identified post-treatment conditions to the post-treatment device 5 via the communication portion 66. When the CPU 61 cannot identify the post-treatment conditions, the CPU 61 transmits information indicating that there are no post-treatment conditions to the post-treatment device 5.

Next, the CPU 111 determines whether the post-treatment conditions have been acquired (step S57). When the post-treatment conditions have been acquired from the server 3 (yes at step S57), the CPU 111 performs the post-treatment in accordance with the acquired post-treatment conditions (step S58). When the post-treatment conditions cannot be acquired (no at step S57), the CPU 111 performs the error processing (step S61). An example of when the post-treatment conditions cannot be acquired is when the code reader 85 receives the platen identification information not associated with the print medium information; that is, when the CPU 111 receives information indicating that there is no post-treatment conditions from the server 3. As the error processing, the CPU 111 does not cause the post-treatment device 5 to perform the post-treatment, and causes the platen conveyance mechanism 90 to transfer the platen 6 to the detachment position 90B.

Next, the CPU 111 determines whether the post-treatment is complete (step S59). When the post-treatment cannot be completed (no at step S59), the CPU 111 performs the error processing (step S61). When the CPU 111 determines that the post-treatment is complete (yes at step S59), the CPU 111 transmits, to the server 3, a command to delete the association of the print medium information with respect to the platen identification information of the association table 80 (step S60). The CPU 61 of the server 3 deletes the association of the print medium information with respect to the platen identification information of the association table 80. Further, the CPU 61 deletes the error information, the processing completion information, the print data and the height information. After that, the CPU 111 ends the fourth main processing.

Operational Effects of Embodiment

As explained above, in the above-described embodiment, the following operational effects are achieved. The CPUs 11, 31 and 111 can perform the processing (step S23, step S43, step S58) in the pretreatment device 10, the post-treatment device 5 or the printer 1, on the basis of the platen identification information received by the code readers 27, 35 and 85. Therefore, CPUs 11, 31 and 111 can perform appropriate processing with respect to the platen 6. For example, the appropriate processing means that the pretreatment under proper application conditions and proper heat treatment conditions, the print processing based on proper print data and proper print conditions, or the post-treatment under proper heat treatment conditions is performed on the print medium 7 placed on the platen 6.

Further, the CPUs 11, 31 and 111 can perform the processing (step S23, step S43, step S58) on the basis of at least one of the print content and the processing content associated with the platen identification information received by the code readers 27, 35 and 85. Therefore, the above-described appropriate processing can be performed with respect to the set platen 6.

Further, the platen identification information (PID1 to PID3 . . . ) and the print medium information (ID1 to ID3 . . . ) are associated with each other by the association processing (step S6). Thus, the CPUs 11, 31 and 111 can identify the print medium information (ID1 to ID3) on the basis of the platen identification information (PID1 to PID3), and can perform the processing (step S23, step S43, step S58) on the basis of at least one of the print content and the processing content corresponding to the print medium information. Thus, the above-described appropriate processing is performed with respect to the set platen 6.

Further, the CPUs 11, 31 and 111 can perform the processing (step S23, step S43, step S58) in the pretreatment device 10, the post-treatment device 5 or the printer 1 in correspondence with the platen information obtained from the platen identification information (PID1 to PID3 . . . ).

Further, the CPU 11 can determine whether to perform the processing in the pretreatment device 10, the post-treatment device 5 or the printer 1, on the basis of the platen information included in the print medium information (ID1 to ID3) and the platen identification information (PID1 to PID3 . . . ) (step S19, step S38). Thus, it is possible to increase the possibility that the above-described appropriate processing is performed with respect to the platen 6.

When the print size is larger than the platen size (yes at step S19), the CPU 11 performs the error processing (step S17). It is thus possible to reduce the possibility that an error may occur in the pretreatment device 10, the post-treatment device 5 or the printer 1.

When the code readers 27, 35 and 85 receive the platen identification information that is not associated with the print medium information (ID1 to ID3 . . . ), the processing in the pretreatment device 10, the post-treatment device 5 or the printer 1 is not performed. Therefore, it is possible to inhibit the processing in the pretreatment device 10 and the post-treatment device 5, or the printing in the printer 1 from being performed with respect to the platen 6 having the platen identification information that is not associated with the print medium information (ID1 to ID3 . . . ). It is thus possible to reduce print failures on the print medium 7 or processing failures in the pretreatment device 10 and the post-treatment device 5.

When an error occurs in the processing in the pretreatment device 10, the post-treatment device 5 or the printer 1 (yes at step S24, yes at step S44, no at step S59), the error association processing (step S25, step S47, step S61) that associates the error information with the platen identification information (PID1 to PID3 . . . ) is performed. Therefore, when the code readers 27, 35 and 85 receive the platen identification information associated with the error information (yes at step S35, yes at step S55), the processing in the printer 1 or in the post-treatment device 5 is not performed (step S47, step S61) Thus, it is possible to inhibit the subsequent processing from being performed on the print medium 7 for which the error has occurred during the processing in the pretreatment device 10 or in the printer 1.

When the post-treatment (step S58) is complete (yes at step S59), the CPU 111 performs the deletion processing (step S60) that deletes the association of the print medium information (ID1 to ID3 . . . ) with respect to the platen identification information (PID1 to PID3 . . . ). It is thus possible to associate the new print medium information with the platen identification information, without newly providing the platen identification information.

Even when the platen 6 is conveyed between the pretreatment device 10, the printer 1 and the post-treatment device 5 by the platen conveyance mechanism 90, the code readers 27, 35 and 85 can receive the platen identification information from the platen 6 that is conveyed.

The CPUs 11, 31 and 111 perform the height association processing (step S41) that associates the platen identification information with the height information that is based on the height detected by the height sensor 73. Therefore, the platen height is identified by the platen identification information and is used in the processing.

When the height of the platen 6 detected by the height sensor 73 is not within the predetermined range (no at step S40), the CPUs 11, 31 and 111 do not perform the processing in the print device 1 or in the post-treatment device 5 (step S47). Therefore, it is possible to inhibit the processing in the printer 1 or in the post-treatment device 5 from being performed with respect to the platen 6 whose height is not within the predetermined range, and to reduce the possibility of the occurrence of the print failure.

The CPU 31 performs the height adjustment processing (step S42) on the basis of the height detected by the height sensor 73. Thus, the platen height can be adjusted to a height that is appropriate for the print processing. It is thus possible to reduce the possibility of the occurrence of the print failure.

When the code reader 69 receives the print medium information 71, the CPU 61 of the server 3 starts to create the print data (step S7). Therefore, the print data to be used in the printer 1 is created in advance and transmitted to the printer 1 or held in the server 3. As a result, it is not necessary to create the print data in the printer 1, and processing time can be shortened.

The CPU 31 can acquire the print data created in advance, on the basis of the platen identification information received by the code reader 35 of the printer 1 (step S36). Therefore, the print data can be easily acquired.

The platen identification information portion 608 of the platen 6 is associated with the processing in the pretreatment device 10, the post-treatment device 5 or the printer 1, and can indicate the platen identification information that identifies the platen 6.

Figure 17:
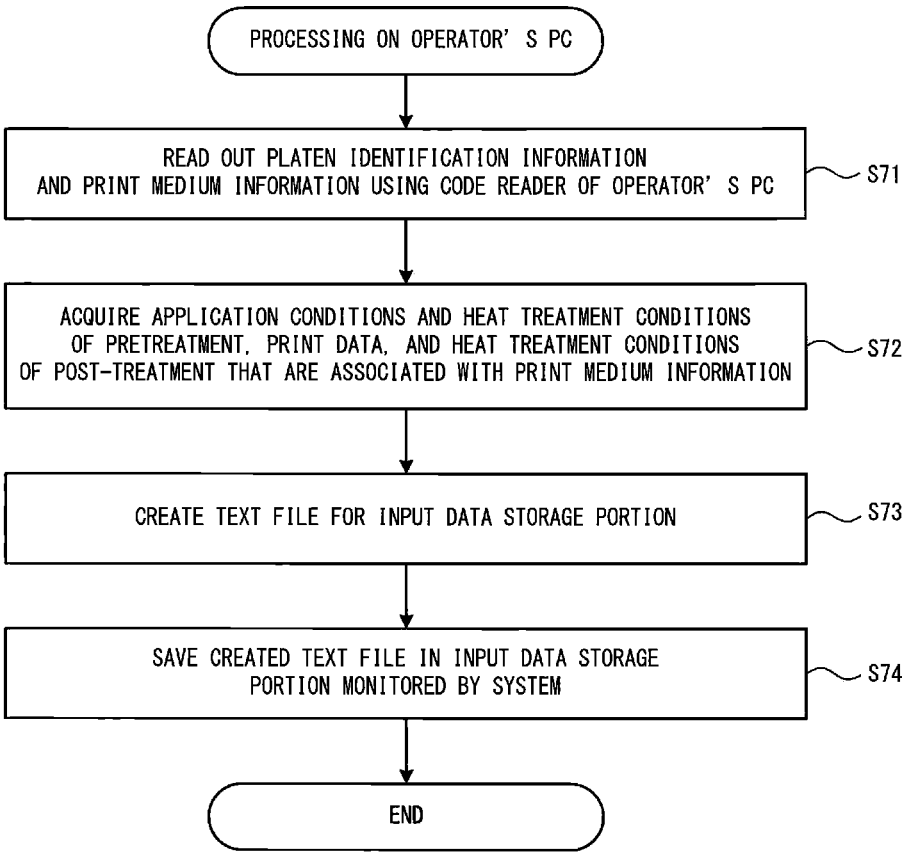
FIG. 17 is a flowchart of processing on a PC of an operator.

Next, processing of a case in which the print medium information cannot be acquired from the code reader 69 will be explained with reference to FIG. 17 and FIG. 18. When the CPU 51 of the terminal device 2 cannot acquire the print medium information from the code reader 69, the print medium information is created using the PC of the operator. Hereinafter, the creation of the print medium information using the PC of the operator will be explained. Note that the PC of the operator may be the terminal device 2 or may be another PC. Before the first main processing, a CPU of the PC of the operator uses a code reader and reads out, in advance, the platen identification information and the print medium information of the print medium 7 (step S71). Next, the CPU of the PC of the operator acquires the application conditions and the heat treatment conditions of the pretreatment, the print data, and the heat treatment conditions of the post-treatment, which are associated with the print medium information (step S72). For example, the CPU of the PC of the operator acquires the application conditions and the heat treatment conditions of the pretreatment, the print data, and the heat treatment conditions of the post-treatment by an input by the operator. Next, in response to the operation by the operator, the CPU of the PC of the operator creates a text file 84 for an input data storage portion (step S73). The text file 84 shown in FIG. 18 indicates information of the amount of the print data (Pt Amount) and the file name (PrintData) of the server on which the application conditions and the heat treatment conditions of the pretreatment, the print data, and the heat treatment conditions of the post-treatment exists, corresponding to the platen identification information (PlatenID). Next, the CPU of the PC of the operator saves the created text file 84 in the input data storage portion that is monitored by the print processing system 100 (step S74). The HDD 64 is an example of the "input data storage portion." In the process of step S6 shown in FIG. 13, the CPU 61 of the server 3 associates an information of the input data storage portion (HDD 64) in which the text file 84 exists with the platen identification information (PID1 to PID3 . . . ), and the correspondence relationship between the platen identification information and the information of the input data storage portion (64) is stored in the HDD 64. Thus, even when the print medium information cannot be acquired from the code reader 69, in the process of S36 shown in FIG. 15, the CPU 31 of the printer 1 can acquire the application conditions and the heat treatment conditions of the pretreatment, the print data, and the heat treatment conditions of the post-treatment by using the text file 84 submitted to the input data storage portion. Therefore, the CPU 31 of the printer 1 can perform the printing. The text file 84 may directly indicate the application conditions and the heat treatment conditions of the pretreatment, the print data, and the heat treatment conditions of the post-treatment.

The present invention is not limited to the above-described embodiment and various modifications are possible. For example, the position of the platen identification information portion 608 is not limited to a side surface of the platen 6. The platen identification information portion 608 may be provided at any position, such as the front surface 604, the rear surface 605 or the lower surface 607, as long as it is not covered by the print medium 7. Further, the platen identification information portion 608 may be formed by near field communication (NFC). Further, the platen identification information portion 608 may be formed by a plurality of shielding plates, and may be configured such that the platen identification information is detected by an optical sensor. Further, the platen identification information portion 608 may be formed by a plurality of concave and convex sections, and may be configured such that the platen identification information is detected by a switch or the optical sensor. Further, the platen identification information may be input from the operation portion 22 of the pretreatment device 10, the operation portion 36 of the printer 1, the operation portion 122 of the post-treatment device 5, and the operation portion 55 of the terminal device 2, and may be received by each of the CPUs. The print medium information may also be input from the operation portion 55 of the terminal device 2, and may be received by the CPU 51. Further, the types of the platen 6 are not limited to the two types. For example, three types or five types with different heights may be used. The platen 6 may be used for a hat, shoes and the like, in addition to being used for the cloth.

Furthermore, the association between the platen identification information, the print medium information, the error information, the print data and the height information may be performed using an application programming interface (API). Further, when the deletion processing to delete the association is performed at step S60, the data for the association between the platen identification information, the print medium information, the error information, the print data and the height information may be saved in the HDD 64. In this case, when a failure occurs in the printed print medium 7, a cause of the failure can be traced.

Moreover, the platen 6 conveyed to the detachment position 90B by the platen conveyance mechanism 90 may be automatically returned by providing a conveyance path through which the platen 6 is returned to the mounting position 90A. Further, the CPU 51 of the terminal device 2 may perform all the first to fourth main processing, and may control the pretreatment device 10, the printer 1, the post-treatment device 5 and the server 3 via the network 4. Further, the CPU of one of the pretreatment device 10, the printer 1, the post-treatment device 5 and the server 3 may perform all the first to fourth main processing, and may control the other devices via the network 4. Further, not all of the pretreatment device 10, the printer 1 and the post-treatment device 5 need necessarily be provided. The present invention can also be applied to a combination of the pretreatment device 10 and the printer 1, or a combination of the printer 1 and the post-treatment device 5. In addition, a plurality of the printers 1 may be provided serially. Further, the pretreatment device 10, the printer 1 and the post-treatment device 5 need not necessarily be provided with the code readers 27, 35 and 85, respectively. Further, the height sensor 73 may also be provided in the pretreatment device 10 or in the post-treatment device 5, in addition to being provided in the printer 1. Further, not all the respective steps of the first to fourth main processing need necessarily be performed. The respective steps may be performed appropriately according to need, depending on the device configuration of the print processing system 100. The association table 80, the first table 81, the second table 82 and the third table 83 may be stored in a device other than the server 3. Further, each of the first to fourth main processing may be performed by a specific CPU that controls the print processing system 100, instead of being performed by the CPU of each device. For example, the CPU 51 may perform the second main processing to the fourth main processing via the network 4. The CPU 11 may perform the first main processing, the third main processing, and the fourth main processing via the network 4. Further, the CPU 31 may perform the first main processing, the second main processing, and the fourth main processing via the network 4. Further, the CPU 111 may perform the first main processing to the third main processing via the network 4. Further, the code reader 68 and the code reader 69 may be connected to the CPUs 11, 31, 111 via the network 4. Further, the code reader 27 may be connected to the CPUs 31, 51 and 111 via the network 4. Further, the code reader 35 may be connected to the CPUs 11, 51 and 111 via the network 4. Further, the code reader 85 may be connected to the CPUs 11, 31, 51 via the network 4.

Moreover, the light emitting portions 73A and the light receiving portions 73B of the height sensor 73 may be provided above the path through which the platen 6 is conveyed. In this case, the light travels downward from the light emitting portions 73A. The light reflected by the upper surface of the print medium 7 placed on the platen 6 enters the light receiving portions 73B, and thus the height is detected. Further, the print data in a raster format created by the server 3 may be held in the HDD 64 of the server 3. In this case, the code reader 35 of the printer 1 reads out the platen identification information, and in response to a request from the CPU 31, the print data may be sent from the server 3 to the printer 1. Further, the processing in the pretreatment device 10, the printer 1 and the post-treatment device 5 need not necessarily be performed by associating the platen identification information with the print medium information, and whether or not to perform the processing in the pre-pretreatment device 10, the printer 1 and the post-treatment device 5 may be determined on the basis of whether or not there is the platen identification information. When the platen identification information portion 608 is not provided on the platen 6, there is a possibility that the height of the platen 6 may not be suitable for the pretreatment device 10, the printer 1 and the post-treatment device 5. In addition, there is a possibility that the platen 6 cannot withstand the heat treatment. Therefore, when the platen identification information cannot be read out from the platen identification information portion 608 by the code reader 68, the platen 6 may be conveyed to the detachment position 90B without performing the pretreatment, the print processing and the post-treatment on the print medium 7 placed on the platen 6. Note that the error association processing that associates the error information with the platen identification information need not necessarily be performed. Although the height sensor 73 is provided in the printer 1, the height sensor 73 may be provided at any position of the platen conveyance mechanism 90, and may be connected to any CPU of the pretreatment device 10, the post-treatment device 5, and the terminal device 2. Therefore, the processing at steps S40, S41, S42, and S47 may be performed in any of the first to fourth main processing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A processing device comprising:

a first reception portion configured to receive, from a platen identification information portion provided on a platen, platen identification information that identifies the platen, the platen being used in a printer and in a related device that is at least one of a pretreatment device and a post-treatment device;

a first processing portion configured to perform processing in one of the printer and the related device, on the basis of the platen identification information received by the first reception portion; and a conveyance device conveys the platen from the first reception portion to the first processing portion, wherein the first reception portion is disposed upstream of the first processing portion, the first reception portion receives the platen identification information that is associated with at least one of print content in the printer and processing content in the related device, and the first processing portion performs the processing content associated with the platen identification information, the processing device further comprises:

a second reception portion configured to receive print medium information of a print medium that is set on the platen;

a third reception portion provided at a position on the same side as the second reception portion with respect to the first reception portion, and configured to receive the platen identification information from the platen identification information portion; and a first control portion connected to the second reception portion and the third reception portion, wherein the first control portion performs association processing that associates the platen identification information received by the third reception portion with the print medium information received by the second reception portion, when an error occurs in the processing in one of the printer and the related device, the first processing portion performs error association processing that associates error information with the platen identification information, and when the first reception portion receives the platen identification information associated with the error information, the first processing portion does not perform the processing in one of the printer and the related device, and the conveyance device conveys the platen.

2. The processing device according to claim 1, wherein the first reception portion receives the platen identification information that includes platen information relating to the platen, and the processing device further comprises:

a second processing portion configured to perform processing in one of the printer and the related device on the basis of the platen information included in the platen identification information received by the first reception portion.

3. The processing device according to claim 1, wherein the third reception portion receives the platen identification information that includes platen information relating to the platen, and the first control portion determines whether to perform processing in one of the printer and the related device, on the basis of the print medium information received by the second reception portion and the platen identification information received by the third reception portion.

4. The processing device according to claim 1, wherein the second reception portion receives a print size as the print medium information, the third reception portion receives a platen size as the platen information relating to the platen, and the first control portion performs error processing when the print size is larger than the platen size.

5. The processing device according to claim 1, wherein when the first reception portion receives the platen identification information that is not associated with the print medium information, the first processing portion does not perform the processing in one of the printer and the related device.

6. The processing device according to claim 1, wherein when the processing is complete in the printer and the related device, the first processing portion performs deletion processing that deletes the association of the print medium information with respect to the platen identification information.

7. The processing device according to claim 1, wherein the first reception portion receives the platen identification information from the platen that is conveyed by a conveyance device that conveys the platen between the printer and the related device.

8. The processing device according to claim 1, further comprising:

a height detection portion configured to detect a height of the platen, wherein the first processing portion performs height association processing that associates the platen identification information with height information that is based on the height detected by the height detection portion.

9. The processing device according to claim 8, wherein when the height detected by the height detection portion is not within a predetermined range, the first processing portion does not perform the processing in one of the printer and the related device.

10. The processing device according to claim 8, wherein a control portion of the printer performs height adjustment processing that adjusts the height of the platen on the basis of the height detected by the height detection portion.

11. The processing device according to claim 1, wherein when the second reception portion receives the print medium information, the first control portion issues a print data creation command to create print data to be used in the printer.

12. The processing device according to claim 11, wherein a control portion of the printer performs print data acquisition processing that acquires the print data on the basis of the platen identification information received by the first reception portion.

13. The processing device according to claim 1, wherein when the print medium information cannot be acquired from the third reception portion, in the association processing, the first control portion associates an input data storage portion with the platen identification information, and a control portion of the printer causes printing to be performed on the basis of the print data stored in the input data storage portion associated with the platen identification information received by the first reception portion.

* * * * *